US006539617B2

(12) United States Patent
Abe

(10) Patent No.: US 6,539,617 B2
(45) Date of Patent: Apr. 1, 2003

(54) AUTOMATIC CONNECTOR ASSEMBLING APPARATUS AND METHOD

(75) Inventor: Koshi Abe, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 09/905,136

(22) Filed: Jul. 13, 2001

(65) Prior Publication Data

US 2002/0004979 A1 Jan. 17, 2002

(30) Foreign Application Priority Data

Jul. 17, 2000 (JP) ..... 2000-215735

(51) Int. Cl.[7] ..... H01R 43/00

(52) U.S. Cl. ..... 29/748; 29/742; 29/749; 29/754

(58) Field of Search ..... 29/728, 742, 747, 29/748, 749, 753, 754

(56) References Cited

U.S. PATENT DOCUMENTS 3,380,140 A 4/1968 Champ
3,416,212 A 12/1968 Busler et al.

FOREIGN PATENT DOCUMENTS

JP 10-335037 12/1998

*Primary Examiner*—Gregory Huson
*Assistant Examiner*—Peter devore

(57) ABSTRACT

An apparatus is provided for mounting a wire assembly made up of a ferrite and terminal-provided wires into a connector housing (C). The connector housing (C) includes a main body (C1) and a cover (C2) that are connected by a connecting piece. Operations are automated a mechanism (50) for mounting a portion of a wire assembly (AY) into a housing main body (C1), a mechanism (20, 25) for turning a cover (C2) after the wire assembly (AY) is fully mounted, a mechanism (40, 60) for connecting the cover (C2) with the main body (C1), and a mechanism (40, 70) for inserting a lock into a connector housing (C).

14 Claims, 14 Drawing Sheets

AUTOMATIC CONNECTOR ASSEMBLING APPARATUS AND METHOD

BACKGROUND OF THE INVENTION

1. Field of the Invention

The invention relates to an automatic connector assembling apparatus and to a method for assembling connectors. The connectors may be used for an automotive wiring harness and particularly a wiring harness used for an airbag.

2. Description of the Related Art

FIGS. 1(A), 1(B) and 2 show a known connector that can be used in a wiring harness for an air bag and that can be assembled by an apparatus according to the present invention. The connector shown in FIGS. 1(A), 1(B) and 2 enables a wire assembly AY to be mounted into a connector housing C and locked by a lock C4.

The wire assembly AY has two wires W, terminals T crimped into connection with the ends of the wires W, and a ferrite F assembled onto the wires W at locations spaced slightly from the terminals T.

The connector housing C is formed integrally with a main body C1 that has upwardly open terminal cavities V1 and an upwardly open ferrite cavity V2 for accommodating the respective terminals T and the ferrite F of the wire assembly AY. The connector housing C also has a cover C2 for substantially covering the housing main body C1, and a connecting piece C3 that hingedly connects the main body C1 and the cover C2.

The cover C2 can be open to expose an upper part of the main body C1, including the cavities V1 and V2, before the wires W are mounted. The cover C2 then can be turned from the state of FIG. 1(A) and placed on the upper part of the main body C1 after the wires W are mounted.

As shown in FIG. 2, hinge recesses C14 are formed at opposite sides of the end of the main body C1 adjacent the connecting piece C3, and hinge projections C24 are formed at the end of the cover C2 adjacent the connecting piece C3. The hinge projections C24 can be engaged in the hinge recesses C14 to enable the cover C2 to be turned smoothly relative to the main body C1 and to maintain a precisely positioned state or relationship.

Locking claws C11 (only one is shown in FIG. 1) are formed at opposite sides of the main body C1 and substantially frame-shaped engaging portions C21 are formed at opposite sides of the cover C2. The frame-shaped engaging portions C21 are engageable with the locking claws C11 to connect the main body C1 and the cover C2 with each other in the closed condition.

The lock C4 comprises a plate C41 to be placed at a specified position on the cover C2, and a pair of locking projections C42 that extend from the plate C41. On the other hand, the cover C2 is formed with holes C22, and the main body C1 is formed with insertion holes C12 that register with the holes C22 of the cover C2 when the cover C2 is closed. The locking projections C42 are dimensioned to be inserted through the registered holes C22 and C12 during assembly of the connector. Each insertion hole C12 in the main body C1 is formed with an unillustrated locking claw, and each locking projection C42 is formed with an unillustrated arrowhead-shaped end. The arrowhead-shaped ends on the locking projections C42 engage the locking claws in the insertion holes C12 of the main body C1 to prevent removal of the lock C4.

The terminals T and the ferrite F are set in the cavities V1, V2 as the wires W are being mounted in the main body C1, as shown in FIG. 1(A). The cover C2 then is turned and closed to cover the main body C1 as shown in FIG. 1(B), and the lock C4 is inserted as indicated by arrows in FIG. 1(B) to assemble the entire connector.

The connector of FIGS. 1(A) and 1(B) has the main body C1 and the cover C2 connected by the connecting piece C3. As a result, there are several operation steps that complicate the assembly of the connector, including turning and connecting the cover C2. Consequently, the connector has been assembled manually. Further, a checking step is required to ensure that the ferrite F has not been forgotten and an electrical connection test is required for the wires W and the terminals T. Thus, the assembling operation is fairly inefficient and takes time and labor.

An object of the present invention is to provide an automatic connector assembling apparatus and method capable of at least partly automatically assembling a connector as described above.

SUMMARY OF THE INVENTION

The invention is directed to a connector assembling apparatus for mounting a wire assembly in a connector housing. The connector housing comprises a main body for accommodating a portion of the wire assembly, a cover connected to the main body, and a lock that can be inserted through the cover and into the main body for locking the wire assembly therein.

The apparatus comprises at least one palette for holding the main body. The apparatus also comprises an assembly pushing mechanism for substantially fully mounting the portion of the wire assembly temporarily placed in the main body while the main body is on the palette. A cover turning mechanism is provided for turning the cover relative to the main body after the assembly pushing mechanism has mounted the portion of the wire assembly. The apparatus further includes a lock inserting mechanism for inserting the lock into the connector housing after the cover is connected. A control means is provided for controllably driving the above-described mechanisms.

Preferably, the automatic connector assembling apparatus further comprises a cover pushing mechanism for pushing the turned cover against the main body to connect them. Additionally, the lock inserting mechanism inserts the lock into the connector housing after the cover is connected by the cover pushing mechanism.

The apparatus can automate mounting the wire assembly into the main body, turning the housing cover, fully mounting the housing cover on the main body, and inserting the locking member into the connector housing.

The palette preferably comprises at least one push-up projection for contacting the cover while the main body is being mounted and pushing up the cover in a state where the wire assembly is mountable. The reference to "a state where the wire assembly is mountable" includes both temporarily placing the wire assembly in the connector housing and fully mounting the wire assembly by the assembly pushing mechanism. In this embodiment, the cover of the connector housing is brought into contact with the push-up projection while the connector housing is being mounted on the palette to be pushed up to a specified position. Thus, the cover turning mechanism and the turning operation performed by the cover turning mechanism can be simplified. Preferably, the push-up projection is formed to position the housing cover at an obtuse angle or at substantially 90° with respect to the housing main body.

The cover turning mechanism preferably comprises a stay that can contact the cover and turn the cover toward the main body when at least one portion of the palette is moved towards the stay.

One or more sensors preferably are provided to determine: whether an engagement of the main body and a hinge of the cover is satisfactory; whether the lock is mounted; whether at least one selected component of the wire assembly is present; and/or whether a connection of the housing main body and the housing cover is satisfactory.

In another embodiment of the invention, the assembly pushing mechanism comprises detecting elements for conducting an electrical connection test for the wire assembly while the wire assembly is being pushed. Thus, the automatic assembling and the electrical connection test can be performed simultaneously, thereby enabling efficient automatic production of higher quality connectors.

The lock inserting mechanism may comprise a lock feed unit for feeding the lock to a predetermined lock feed position, a pick-up unit for picking up the lock from the lock feed position, and a pick-up unit drive for driving the pick-up unit between the lock fee position and a position for mounting the lock into the connector housing. The control means of the apparatus may controllably link the operations of the pick-up unit, the pick-up unit drive and the cover pushing mechanism to synchronize the locking member pick-up and the cover mounting operation by the cover pushing mechanism. The lock feed position preferably is set to enable the pick-up operation and the cover mounting operation to be performed simultaneously. Thus, a working time can be shortened.

The assembly pushing mechanism may comprise a portion for resiliently pushing a component of the wire assembly into the main body simultaneously with another portion for rigidly pushing at least one other component of the wire assembly into the main body.

The invention also is directed to an automatic connector assembling method for mounting a wire assembly in the above-described connector housing. The method comprises holding the main body on a palette. The method then comprises substantially fully mounting in the main body that is on the palette the portion of the wire assembly that had been temporarily placed in the main body. The method proceeds by turning the cover onto the main body after the portion of the wire assembly is substantially fully mounted, and then inserting the lock into the connector housing after the cover is connected.

These and other objects, features and advantages of the present invention will become apparent upon reading of the following detailed description of preferred embodiments and accompanying drawings.

BRIEF DESCRIPTION OF THE DRAWINGS

FIGS. 1(A) and 1(B) are exploded perspective views showing a schematic construction of a connector according to the present invention, wherein FIG. 1(A) shows a state before terminal-provided wires are mounted, and FIG. 1(B) shows a state when a locking member is mounted after the terminal-provided wires are mounted.

DETAILED DESCRIPTION OF THE PREFERRED EMBODIMENTS

Figure 3:
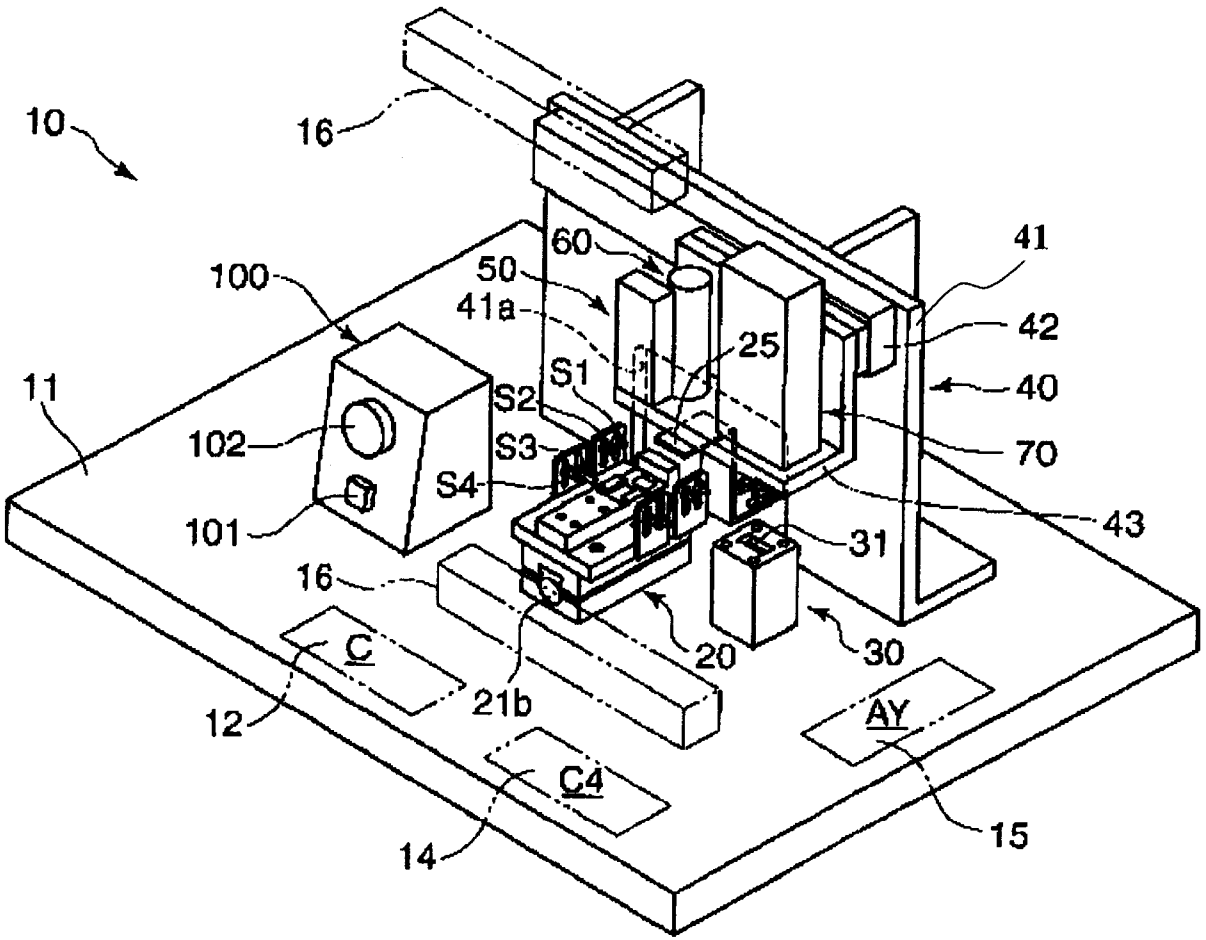
FIG. 3 is a perspective view showing an entire construction of an automatic connector assembling apparatus according to one embodiment of the invention.

An automatic connector assembling apparatus in accordance with the invention is identified by the numeral 10 in FIG. 3. The apparatus 10 automatically assembles a connector housing C, a wire assembly AY and a lock C4 (all shown in FIGS. 1(A) and 1(B)) that are supplied by an operator.

The assembling apparatus 10 includes a table 11, a palette assembly 20 placed on the table 11, a lock feed unit 30 at one side of the palette assembly 20, a cylinder assembly 40 and a controller 100 for controlling the palette assembly 20 and the cylinder assembly 40.

A housing container 12, a lock container 14 and a wire container 15 are disposed on the table 11 for containing housings C, locks C4 and wire assemblies AY respectively. The table 11 has an area sensor 16 formed by a pair of photointerrupters supported on unillustrated vertically spaced frames. The area sensor 16 senses when a hand or the like enters a working area while the units of the apparatus 10 are working, and sends a signal to the control unit 100 so that the operation of the units can be stopped in a moment. The area sensor 16 also may comprise a proximity sensor or an infrared sensor.

Figure 4:
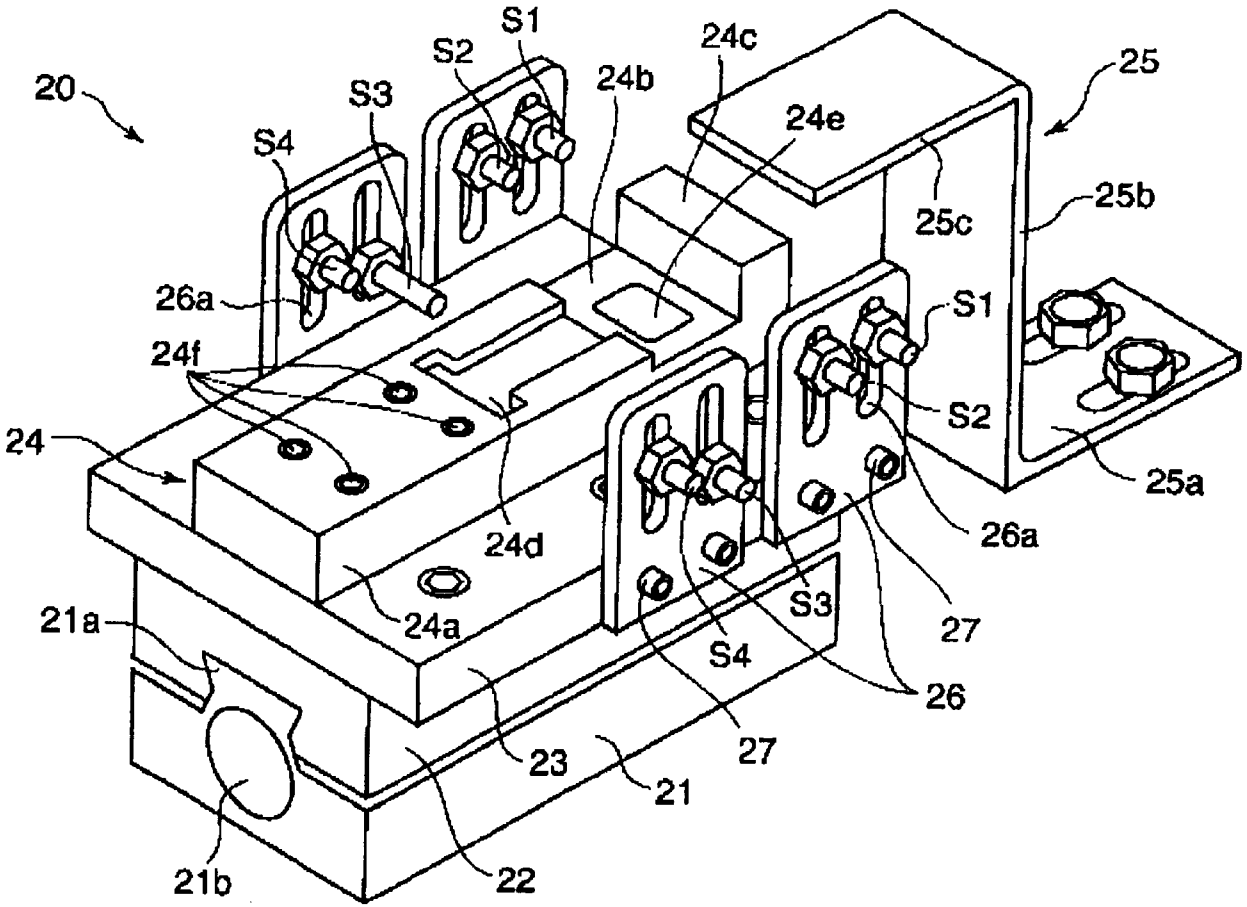
FIG. 4 is an enlarged perspective view showing a palette of the embodiment of FIG. 3.

The palette assembly 20 includes a slide rail 21 that is secured to the table 11, as shown in FIGS. 3 and 4. A dovetail or swallowtail guide 21*a* is formed along the top of the slide rail 21, and extends in forward and backward directions. A slider 22 is mounted slideably on the guide 21*a*, a plate 23 is carried on the slider 22, and the holder 24 is secured to the upper surface of the plate 23.

An air cylinder 21*b* is built into the slide rail 21 below the guide 21*a*. The air cylinder 21*b* reciprocates the slider 22, the plate 23 and the holder 24 in forward and backward directions between a housing mounting position shown in FIG. 4 and a cover turning position shown in FIG. 12 and described later.

The holder 24 preferably is a metallic member with opposite front and rear ends. An elongate base 24*a* is formed integrally or unitarily at the rear end of the holder 24 and a push-up projection 24*c* is formed at the front end of the holder 24. A stepped portion 24*b* is formed between the base 24*a* and the push-up projection 24*c* and is lower than both the base 24*a* and the push-up projection 24*c*.

A recess 24*d* is formed at a front part of the base 24*a*, and communicates with the stepped portion 24*b*. The stepped portion 24*b* also is formed with a recess 24*e*. The recesses 24*d* and 24*e* are configured to receive the main body C1 of the connector housing C.

Figure 5:
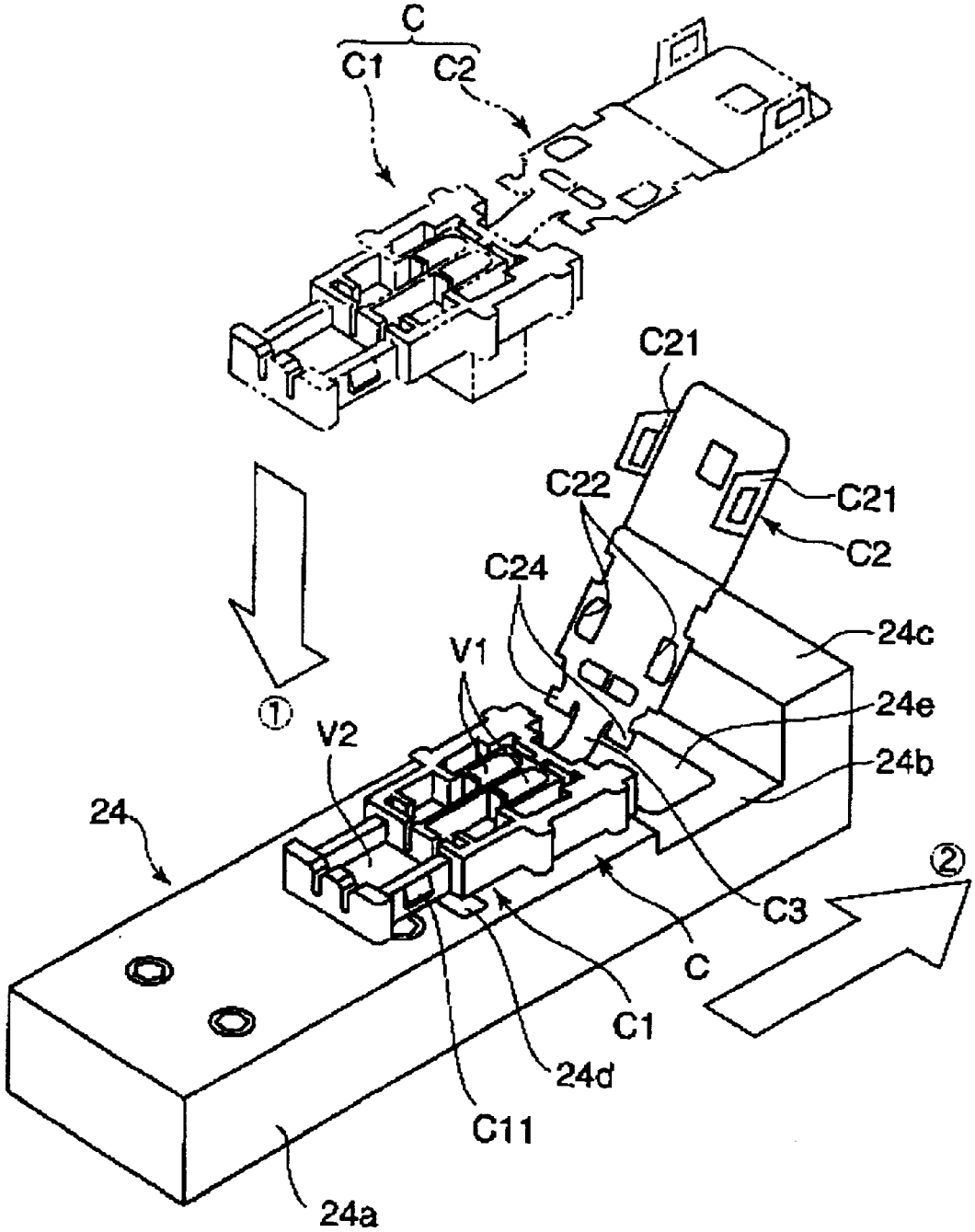
FIG. 5 is a perspective view showing an operation of mounting a connector housing on a palette of the palette unit of FIG. 4.

With reference to FIG. 5, the push-up projection 24*c* can be brought into contact with the cover C2 of the connector housing C when the main body C1 is mounted into the recesses 24*d*, 24*e*, thereby raising the cover C2 to an inclined state indicated by solid lines. More specifically, the connector housing C is placed on the holder 24 from above, as indicated by arrow ①, and then is pushed forward as indicated by arrow ② to fit the connector into the respective recesses 24*d*, 24*e*. The contact with the push-up projection 24*c* during the mounting operation pushes the cover C2 up into a state that does not hinder succeeding operation steps and enables mounting of the wire assembly. Thus, a cover turning mechanism and a cover turning operation can be simplified, as described below.

A cover closing stay 25 projects near the palette assembly 20, as shown in FIG. 4, and defines the mechanism for turning the cover C2. The stay 25 is provided integrally or unitarily with a bottom plate 25*a* that is fastened to the table 11 by bolts, an end plate 25*b* that projects up from an end of the bottom plate 25*a*, and a contact portion 25*c* that extends substantially horizontally and preferably at right angles from the top end of the end plate 25*b* toward the palette assembly 20. The contact portion 25*c* is slightly higher than the pushup projection 24*c* and faces the housing cover C2 that is pushed by the pushup projection 24*c*. When the air cylinder 21*b* moves the slider 22 forward toward the stay 25 at a specified timing, the plate 23 and the holder 24 on the slider 22 approach the stay 25. As a result, the contact portion 25*c* of the stay 25 is brought into contact with the cover C2, and the cover C2 is turned and inclined at an acute angle to the main body C1 (see FIG. 12).

The holder 24 is secured to the plate 23 by bolts 24*f* formed with a hexagonal hole, and thus can be exchanged to conform to the specification of the connector housing C that is to be assembled.

As shown in FIG. 4, two stays 26 are fixed to each side of the plate 23 by bolts 27. Each stay 26 has two vertically aligned oblong holes 26*a*, and four pairs of transversely spaced sensors S1 to S4 are mounted in the oblong holes 26*a*. The sensors S1–S4 preferably are photointerrupters. The sensors S1 determine whether an engagement of the main body C1 of the connector housing C and the hinge recesses C14 and the hinge projections C24 of the cover C2, as shown in FIG. 2, is satisfactory. The sensors S2 determine whether the lock C4 is mounted, and the sensors S3 determine whether the ferrite F (see FIG. 1(A)) is present. Finally, the sensors S4 determine whether a connection of the main body C1 and the cover C2 is satisfactory.

Figure 6:
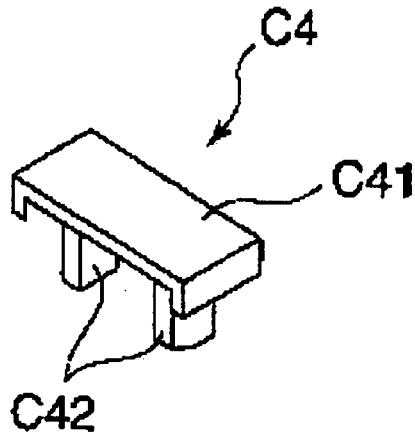
FIG. 6 is a perspective view of a locking member feeding unit of the embodiment of FIG. 3.
Figure 6:
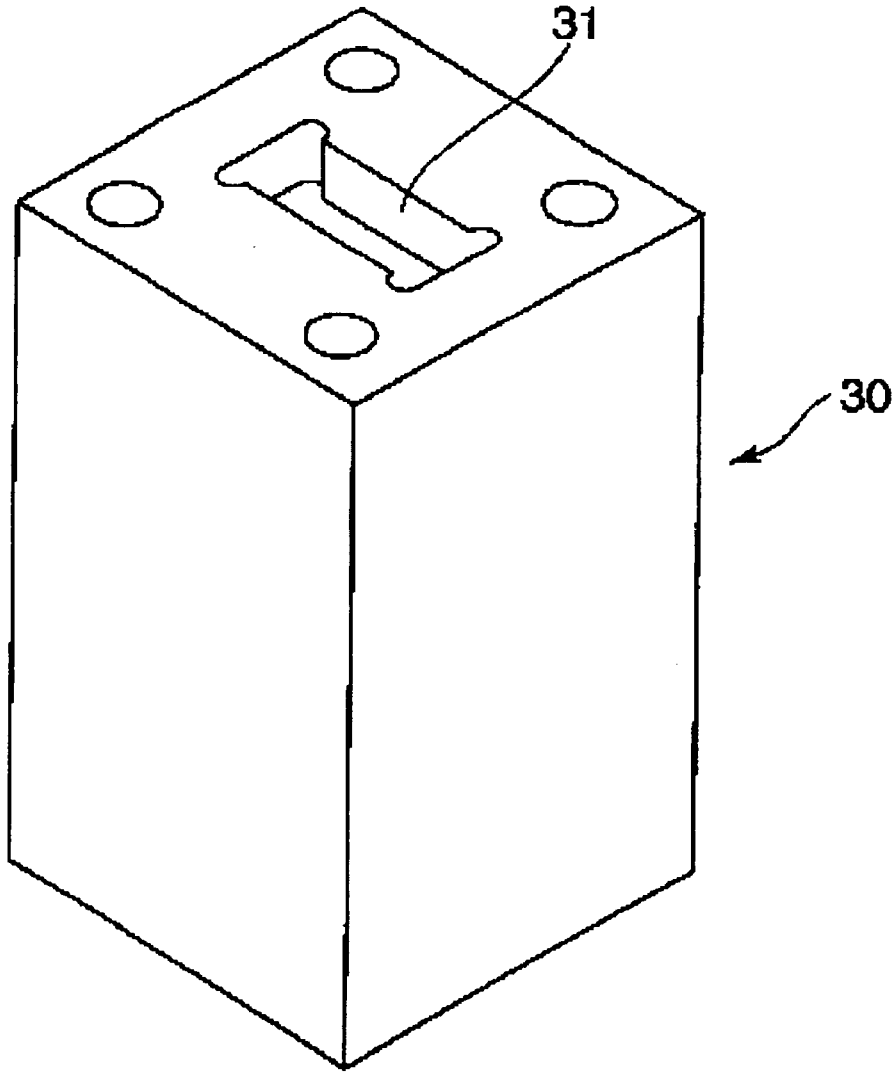

The lock feed unit 30 is a block, as shown in FIGS. 3 and 6, and a recess 31 that is dimensioned to receive the lock C4 is formed in the top of the lock feed unit 30. The operator or any other automatic means mounts the lock C4 into the recess 31 before the automatic connector assembling apparatus 10 is put into operation. The mounted lock C4 then is picked up by the cylinder assembly 40 at a specified timing for mounting into the connector housing C.

The cylinder assembly 40 comprises a carrying plate 41 secured to the table 11 to face the operator, as shown in FIG. 3. A rod-less cylinder 42 is secured to the front surface of the carrying plate 41, and extends horizontally. A cylinder holder 43 is transversely displaceable by the rod-less cylinder 42, and vertically extending air cylinders 50, 60, 70 are supported on the cylinder holder 43.

The carrying plate 41 defines the contour of the cylinder assembly 40, and has a gate 41*a* formed in its middle for exposing the cover closing stay 25 to the palette assembly 20.

The rod-less cylinder 42 is capable of reciprocating the cylinder holder 43 between a home position, shown by solid line in FIG. 3, and a transport position. In the home position, the air cylinders 50 and 60 are above the palette assembly 20 and the air cylinder 70 is above the lock feed unit 30. The transport position is reached by the air cylinder 70 moving the cylinder holder 43 to left of FIG. 3 and substantially above the palette assembly 20.

Figure 7:
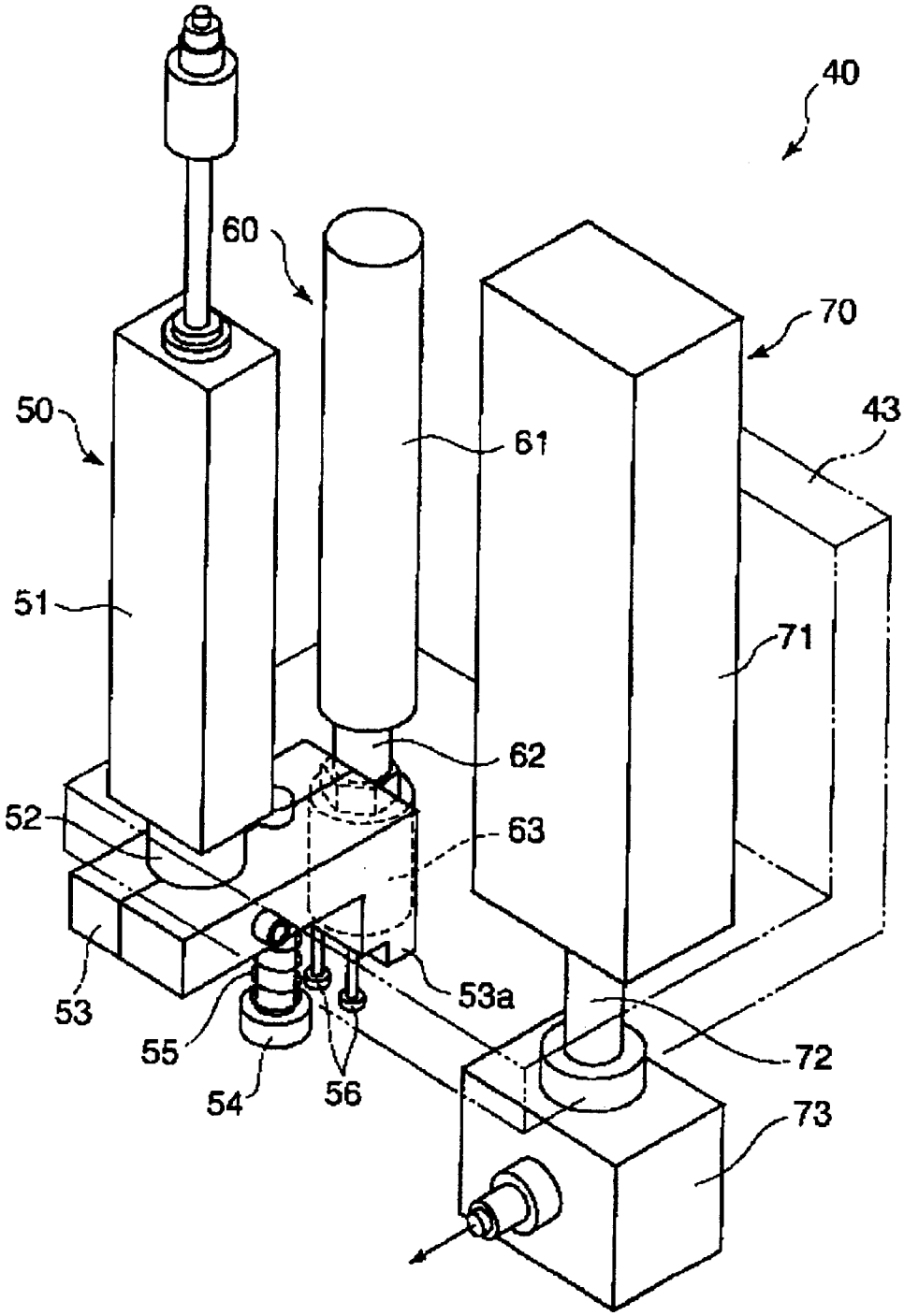
FIG. 7 is a perspective view showing a schematic construction of a cylinder unit of the embodiment of FIG. 3.

With reference to FIG. 7, the air cylinder 50 held by the cylinder holder 43 is a portion of an assembly pushing mechanism and includes a cylinder main body 51. A rod 52 is vertically extendible and contractible by the cylinder main body 51, and a pushing holder 53 is secured to the bottom end of the rod 52. A pushing rod 54 is mounted to be vertically movable toward and away from the table 11, and a coil spring 55 biases the pushing rod 54 down toward the holder 24. Probe pins 56 are mounted on the pushing holder 53. The air cylinder 50 extends the rod 52 when the palette assembly 20 is in the housing mounting position, thereby lowering the pushing holder 53 to push the essential accommodated portion of the wire assembly AY.

Figure 1A:
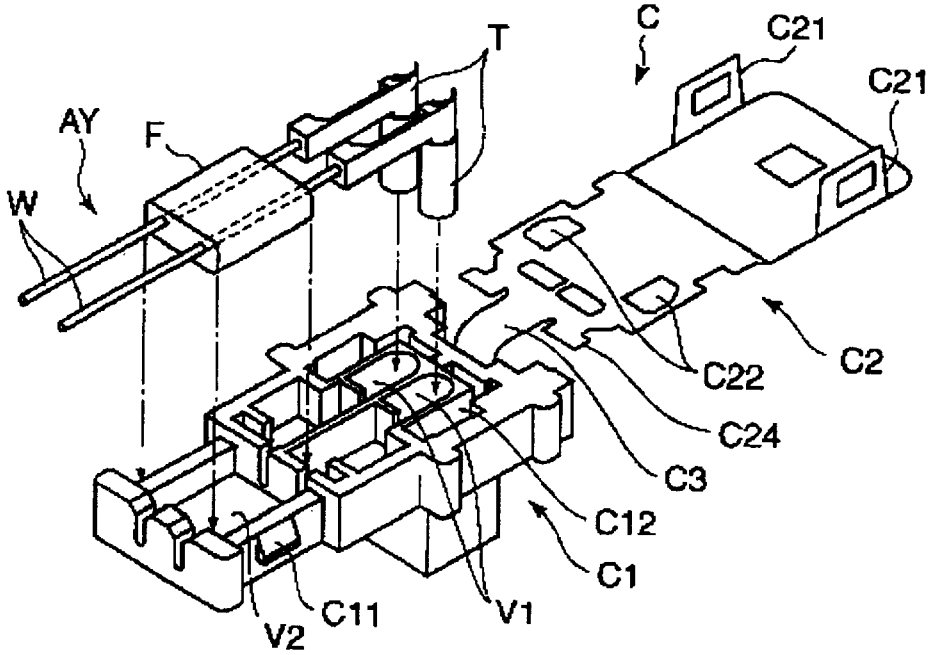
Figure 1B:
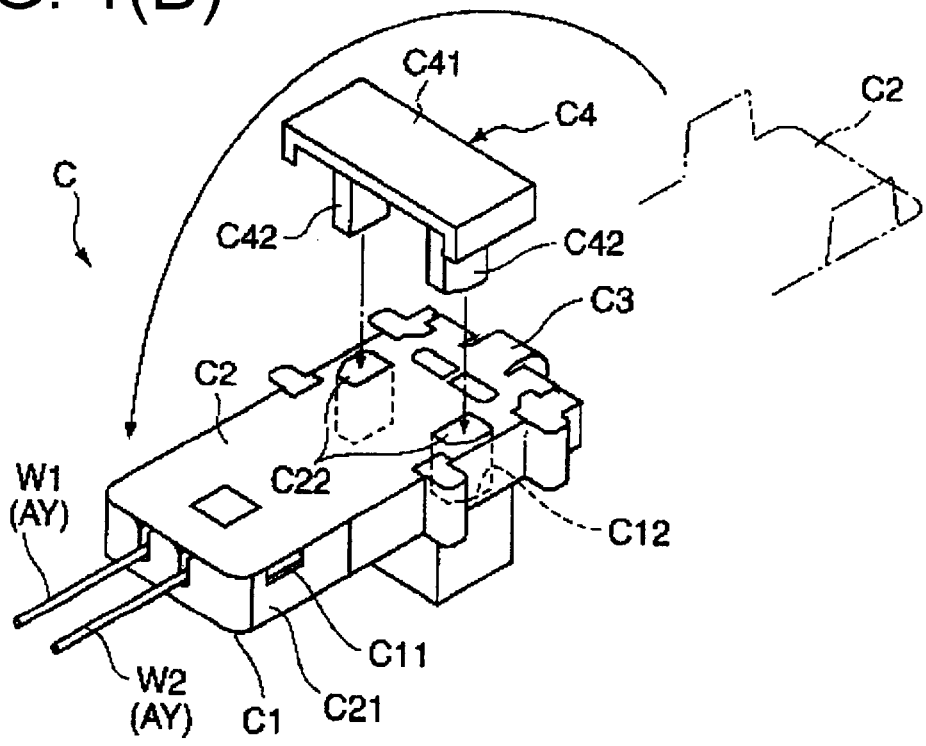
Figure 2:
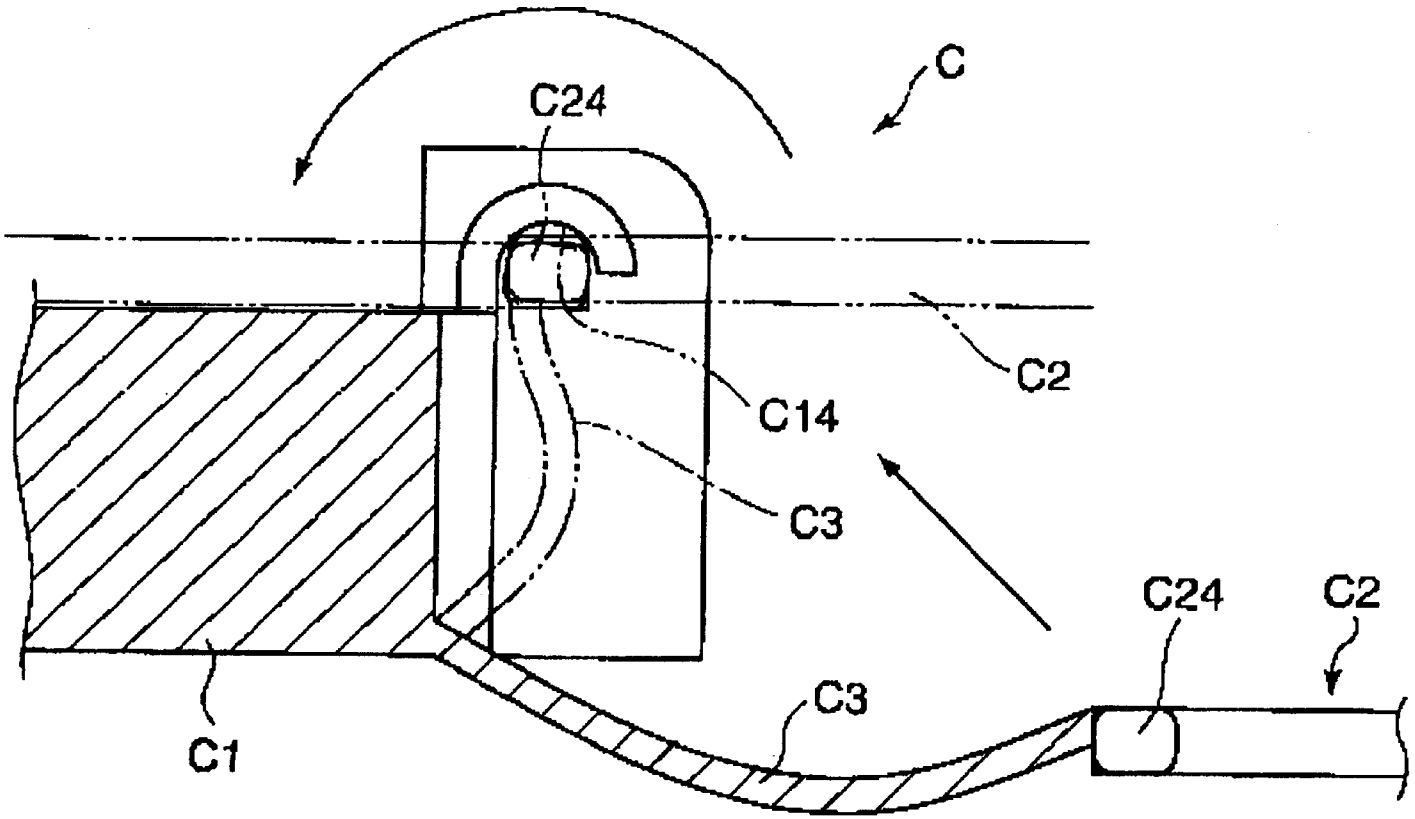
FIG. 2 is An enlarged side view partly in section showing an essential portion of the connector of FIG. 1.
Figure 8:
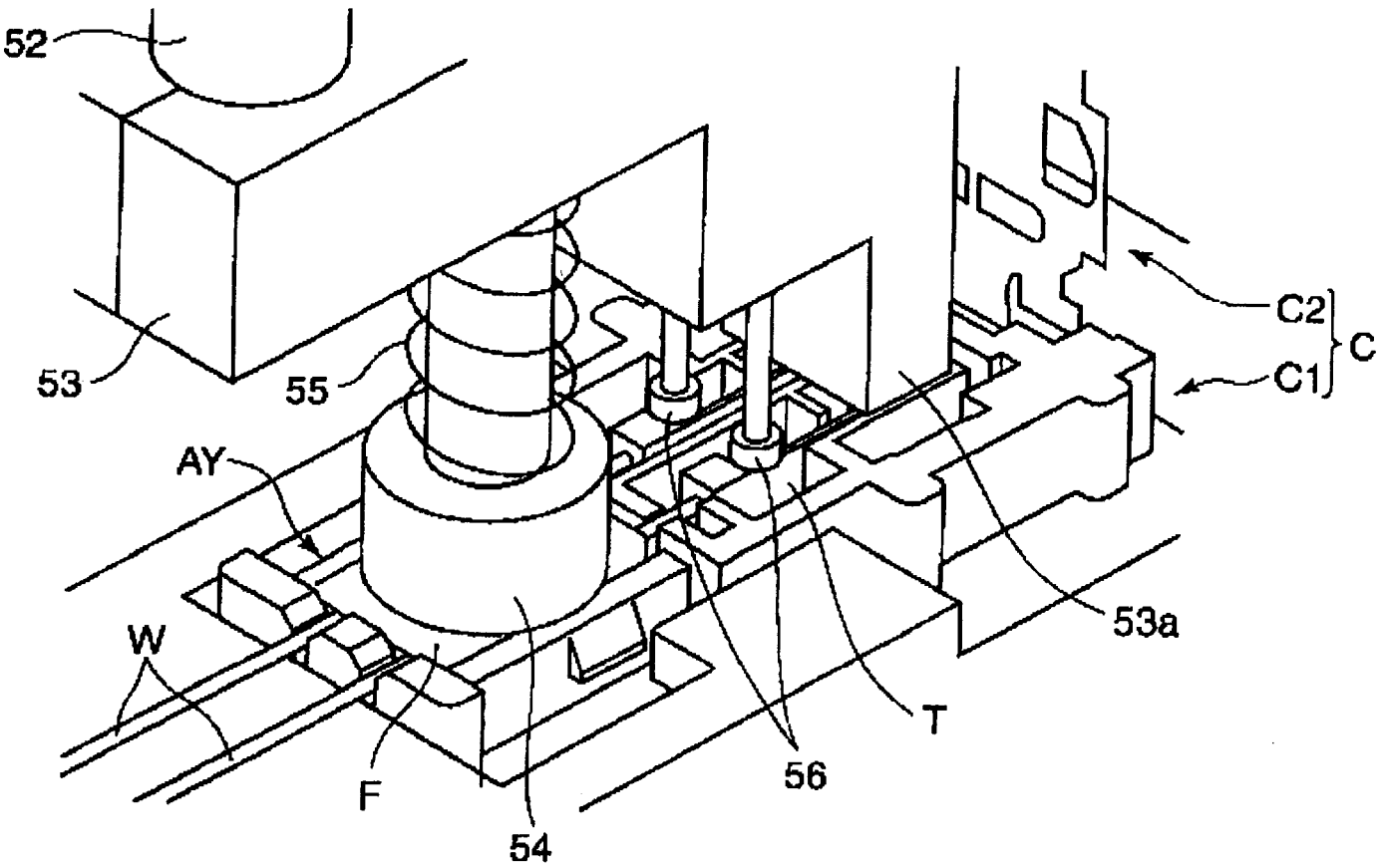
FIG. 8 is a perspective view showing an action of an assembly pushing mechanism of the embodiment of FIG. 3.

With reference to FIGS. 7 and 8, the pushing holder 53 is provided integrally or unitarily with a projection 53*a* for pushing the terminals T of the wire assembly AY (see FIG. 1(A)) that have been placed temporarily on the connector housing C mounted on the holder 24. This projecting portion 53*a* pushes the terminal T down during descent. Thus, the terminals T of the wire assembly AY can be mounted fully into the main body C1 positioned on the holder 24.

The pushing rod 54 mounted on the pushing holder 53 pushes the ferrite F of the wire assembly AY during descent of the pushing holder 53 to mount the ferrite F in the cavity in the main body C1. The pushing rod 54 is coupled elastically to the pushing holder 53. As a result, the ferrite F can be pushed with a necessary and sufficient force while the terminals T are pushed by the pushing holder 53. Thus, the terminals T and the ferrite F arranged on the main body C1 can be inserted substantially simultaneously or synchronously into the main body C1.

The probe pins 56 are connected with an unillustrated electrical connection-testing device and can be brought into electrical contact with the respective terminals T during descent of the pushing holder 53. Thus, the probe pins 56 enable an electrical connection test for the terminals T.

The air cylinder 60 is a cover pushing mechanism for pushing the cover C2 turned by the cover turning mechanism (palette assembly 20 and cover closing stay 25) against the connector housing C to connect the cover C2 and the connector housing C. The air cylinder 60 includes a cylinder main body 61 and a rod 62 that can be extended and contacted vertically by the cylinder main body 61. A pushing member 63 is secured to an end of the rod 62.

The air cylinder 60 is arranged before or adjacent the air cylinder 50 that defines the assembly pushing mechanism. Accordingly, the air cylinder 60 can be located above the palette assembly 20 when the cylinder holder 43 of the palette assembly 40 is in the home position and can be located above the turned cover C2 when the palette assembly 20 is displaced from the housing mounting position to the cover turning position.

The cylinder main body 61 of the air cylinder 60 extends the rod 62 after the palette assembly 20 is displaced to the housing cover turning position, and the pushing member 63 on the rod 62 then pushes the turned cover C2.

The air cylinder 70 is a pick-up unit and part of a mechanism for inserting the lock C4 into the connector housing C after the cover C2 is connected fully by the cover pushing mechanism (air cylinder 60, etc.). The air cylinder 70 includes a cylinder main body 71, a rod 72 that can be extended and contracted vertically by the cylinder main body 71, and a vacuum holder 73 mounted on the bottom end of the rod 72.

The cylinder main body 71 lowers the rod 72 in synchronism with the cover pushing operation by the air cylinder 60 of the cover pushing mechanism, to place the vacuum holder 73 on the upper surface of the lock feed unit 30 to pick up the lock C4 already fed to the lock feed unit 30 by suction (using a negative pressure or vacuum). The palette assembly 20, the lock feed unit 30 and the cylinders 50 to 70 held by the cylinder holder 43 are arranged in positions to enable the above operation.

The rod-less cylinder 42, the cylinder holder 43 and the air cylinder 70 define the lock inserting mechanism for mounting the lock C4 on the connector housing C. This mechanism is controlled by a control unit 100 to mount the picked lock C4 into the connector housing C.

With reference to FIG. 3, the control unit 100 is formed by a microprocessor, a notification buzzer and other electric devices. The control unit 100 is capable of controlling the air cylinder 21 b of the palette assembly 20, the rod-less cylinder 42 of the cylinder unit 40 and the respective cylinders 50 to 70 held by the cylinder holder 43 to link their operations with each other. The control unit 100 also actuates and stops the cylinders in accordance with output signals from the area sensor 16 and the sensors S1 to S4.

The control unit 100 includes an operation switch 101 that enables a series of operations to be performed automatically after actuation of operation switch 101. The control unit also includes an emergency-stop switch 102.

With reference to FIG. 3, the operator preferably stands in front of the automatic connector assembling apparatus 10. The operator then takes the connector housing C (see FIG. 1(A)) from the housing container 12, and places the main body C1 on the holder 24 in the procedure described with reference to FIG. 5. As a result, the cover C2 of the connector housing C is raised automatically to form an obtuse or right angle to the main body C1.

As shown in FIG. 6, the operator then takes the lock C4 from the lock container 14 (see FIG. 3) and sets the lock C4 in the recess 31 of the lock feed unit 30.

Figure 9:
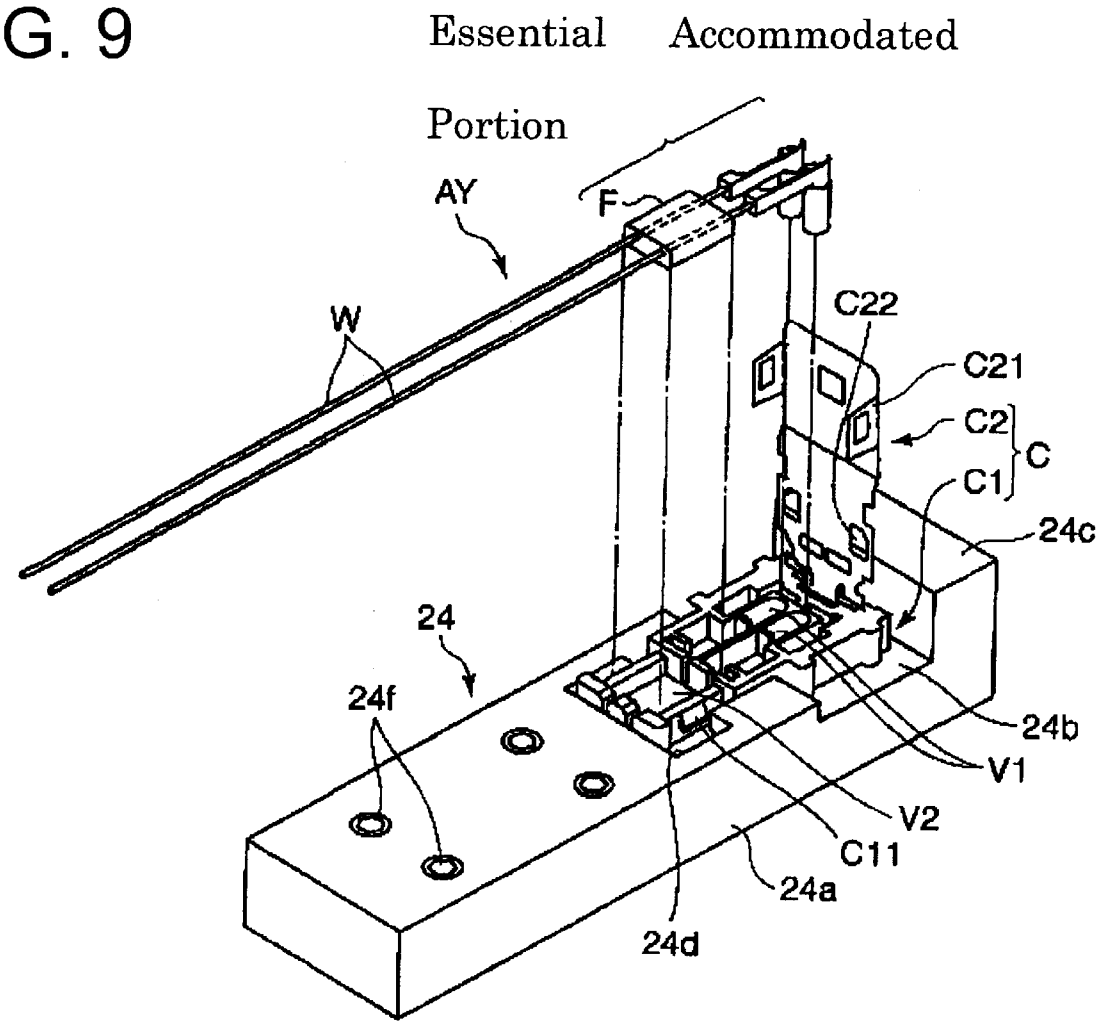
FIG. 9 is a perspective view showing an operation of temporarily placing a wire assembly in the embodiment of FIG. 3.
Figure 10:
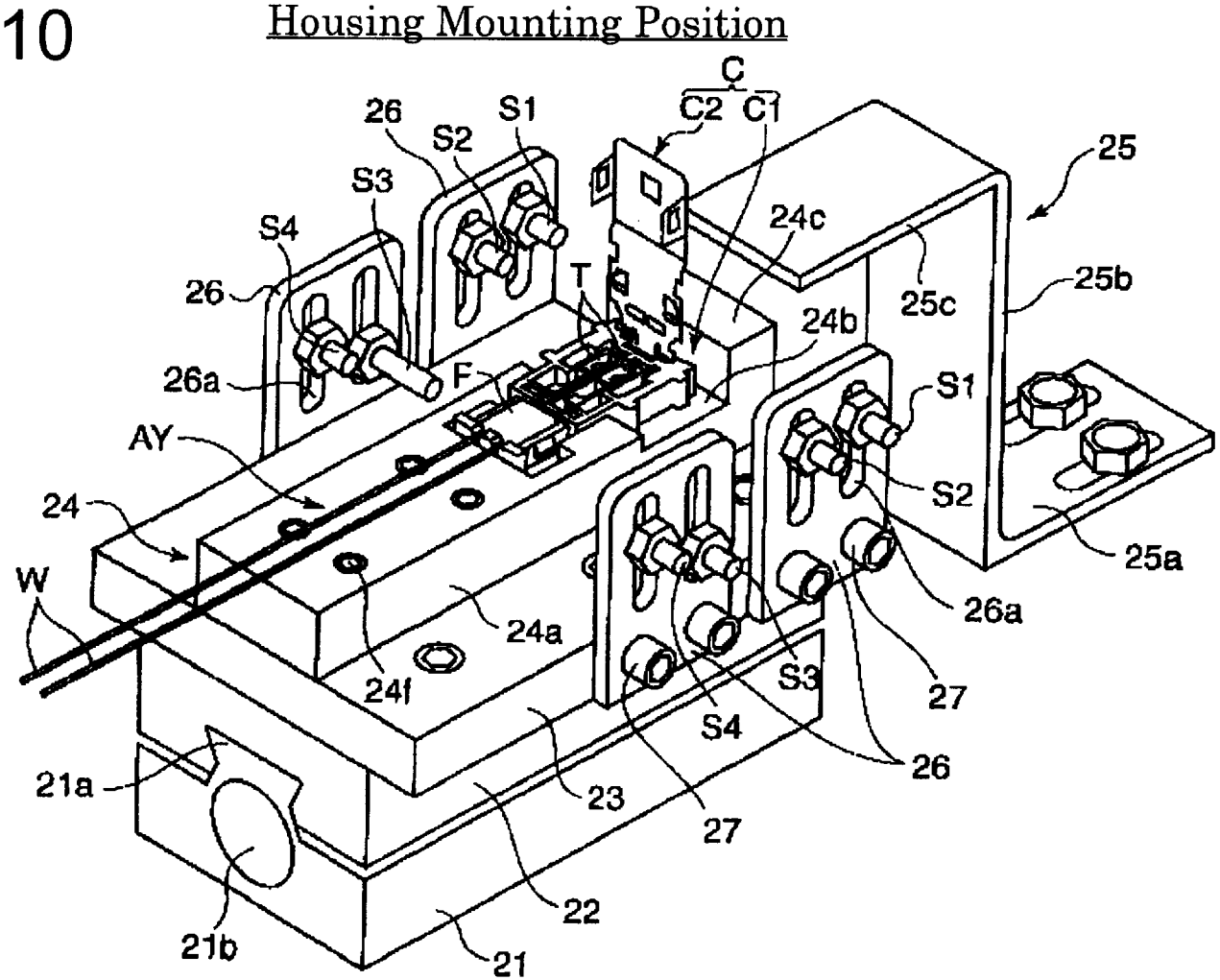
FIG. 10 is a perspective view showing a state after the operation of temporarily placing a wire assembly in the embodiment of FIG. 3.

As shown in FIGS. 9 and 10, the operator next takes the wire assembly AY from the wire container 15 and temporarily places the terminals T and the ferrite F to fit them into corresponding cavities V1, V2 of the main body C1.

The area sensor 16 detects the operator while the connector housing C and the lock C1 are being placed and while the wire assembly AY is being placed temporarily. Thus, there is no danger that the apparatus operates during these operations and safety of the operator is assured. Upon completion of the main body placing operation, the wire assembly temporarily placing operation, and the lock placing operation, the operator confirms that nothing is present in the detecting range of the area sensor 16 and then actuates the operation switch 101 to start the automatic connector assembling apparatus 10.

Figure 11:
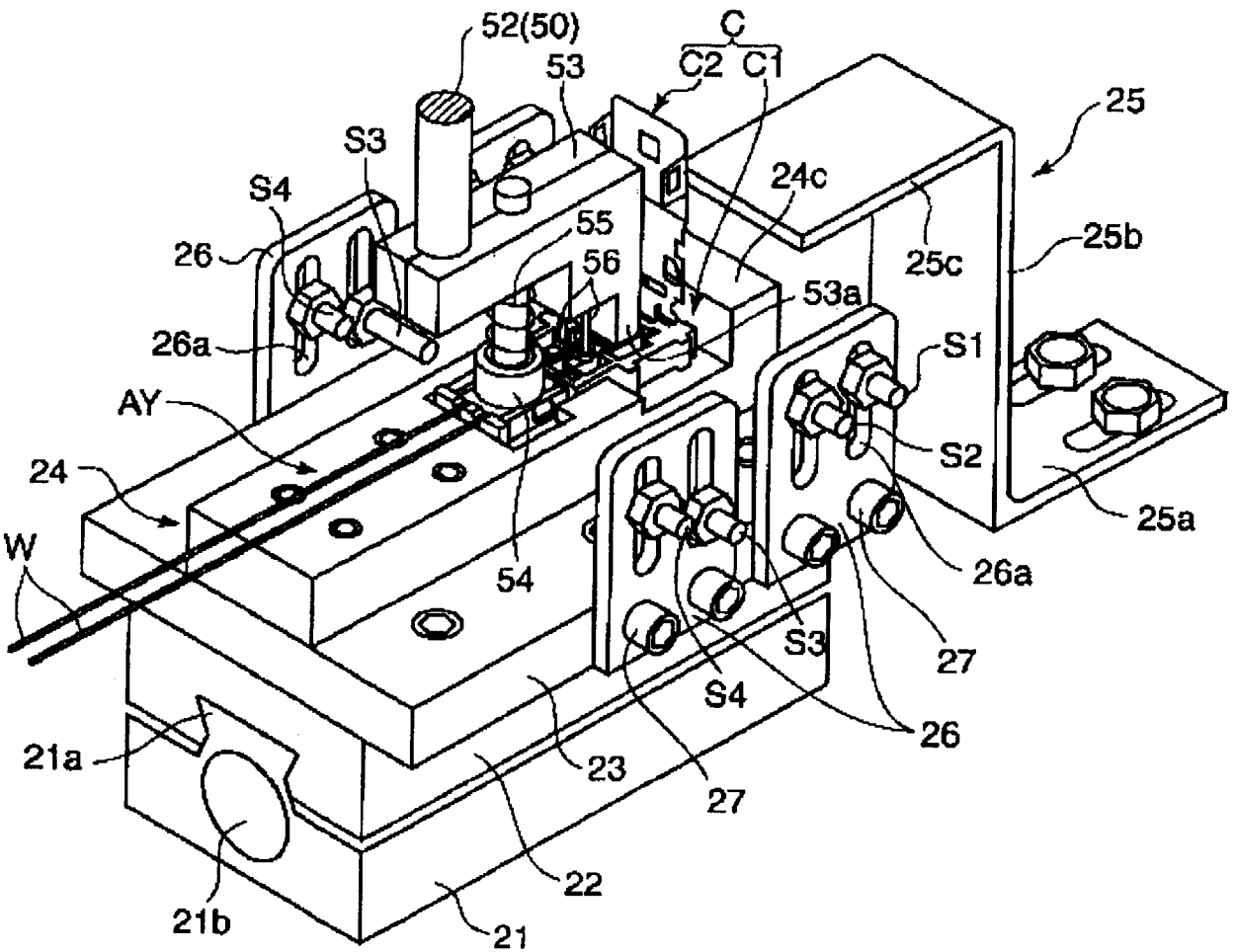
FIGS. 11 to 14 are perspective views showing operations after an operation switch is operated in the embodiment of FIG. 3.

With reference to FIG. 11, when the operation switch 101 is actuated, the control unit 100 drives the air cylinder 50 of the cylinder unit 40 to push the wire assembly AY that had been placed temporarily on the main body C1 on the holder 24 at the housing mounting position by the pushing holder 53. This causes the terminals T to be mounted fully by the projection 53*a* of the pushing holder 53 and causes the ferrite F to be mounted fully into the main body C1 by the pushing rod 54 that is coupled elastically to the pushing holder 53, as described in detail with reference to FIG. 8. Simultaneously, an electrical connection test for the respective terminals T is conducted by the probe pins 56 on the pushing holder 53. A succeeding operation step is performed upon passing the electrical connection test. Upon failing the test, the control unit 100 activates the notification buzzer and interrupts the assembling operation.

Figure 12:
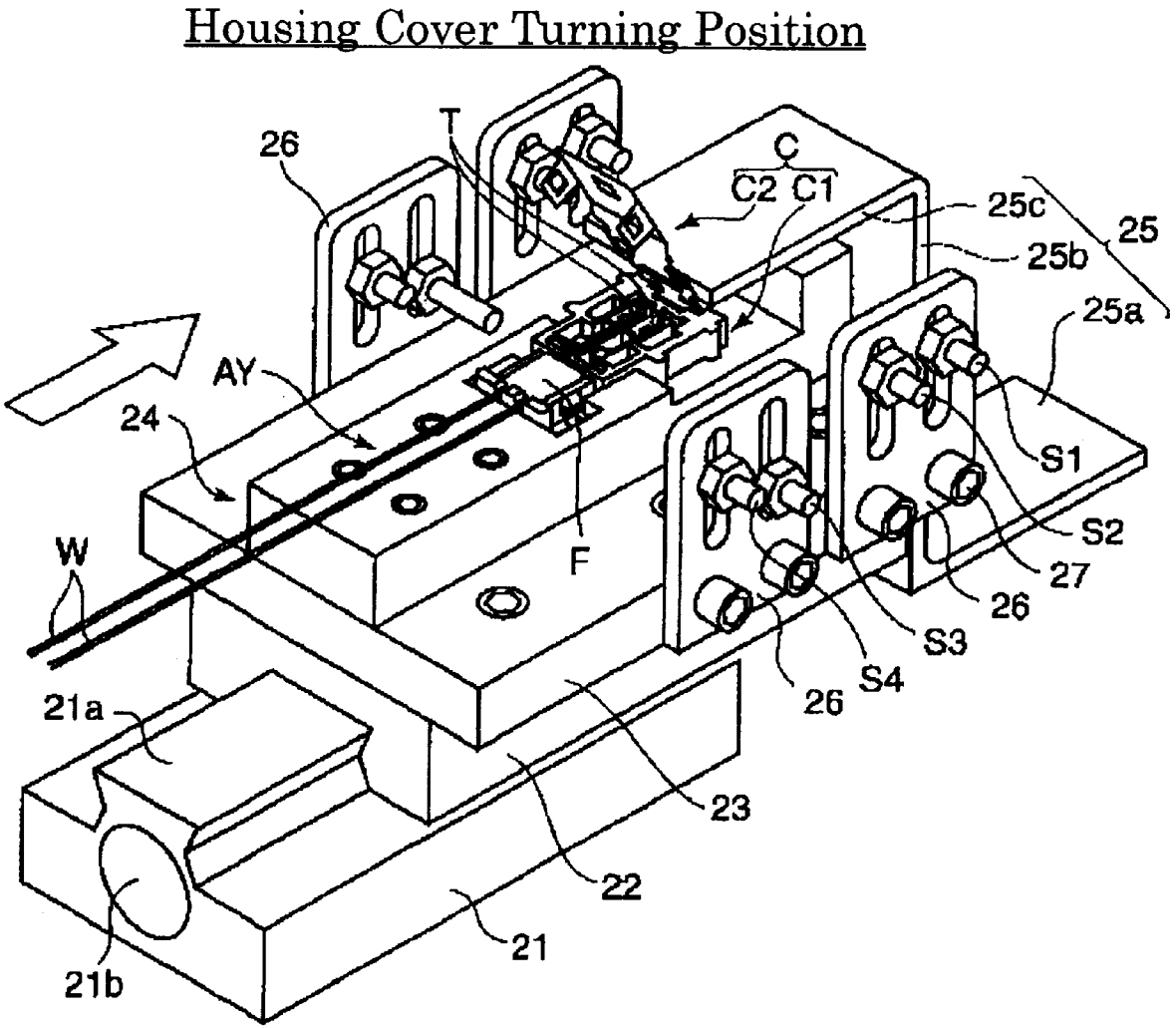

With reference to FIG. 12, the control unit 100 drives the air cylinder 21*b* of the palette assembly 20 upon completion of the operations in FIG. 11, thereby displacing the holder 24 from the housing mounting position to the cover turning position. This causes the cover C2 of the connector housing C to be inclined at an acute angle to the housing main body C1, as shown in FIG. 12, from the state of FIG. 11. As a result, the free end of the cover C2 faces or is located substantially above the ferrite F in the main body C1.

Figure 13:
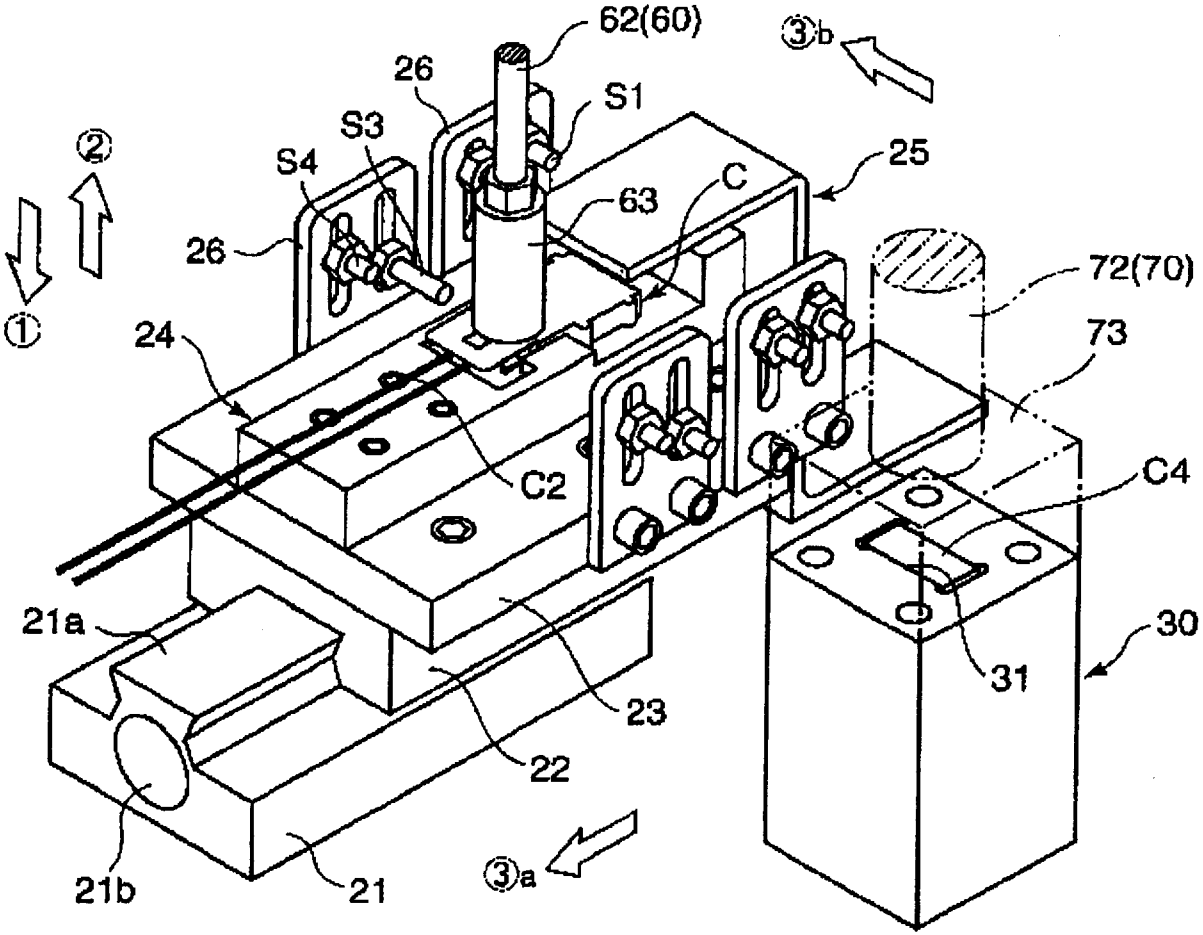

Subsequently, the control unit 100 simultaneously drives the air cylinders 60, 70 of the cylinder unit 40 in the direction of the arrow ① in FIG. 13. Thus, the pushing member 63 of the air cylinder 60 that defines the cover pushing mechanism pushes the cover C2 to achieve full connection of the cover C2 and the main body C1. Simultaneously, the vacuum holder 73 of the air cylinder 70 that defines the pick-up unit uses a negative pressure or vacuum for sucking the lock C4 placed on the lock feed unit 30. Subsequently, the control unit 100 causes the rods 62, 72 of the cylinders 60, 70 to extend simultaneously in the direction of the arrow ② in FIG. 13, thereby retracting the pushing member 63 to a position above the palette assembly 20 and bringing the vacuum holder 73 into a state to convey the lock C4 toward the palette assembly 20 while sucking it. When the rods 62, 72 of the cylinders 60, 70 are extended further, the palette assembly 20 is returned from the cover turning position to the housing mounting position, as indicated by an arrow ③*a* in FIG. 13, and the rod-less cylinder 42 (see FIG. 3) of the cylinder unit 40 displaces the cylinder holder 43 from the home position to the transport position, as indicated by an arrow ③*b* in FIG. 13.

Figure 14:
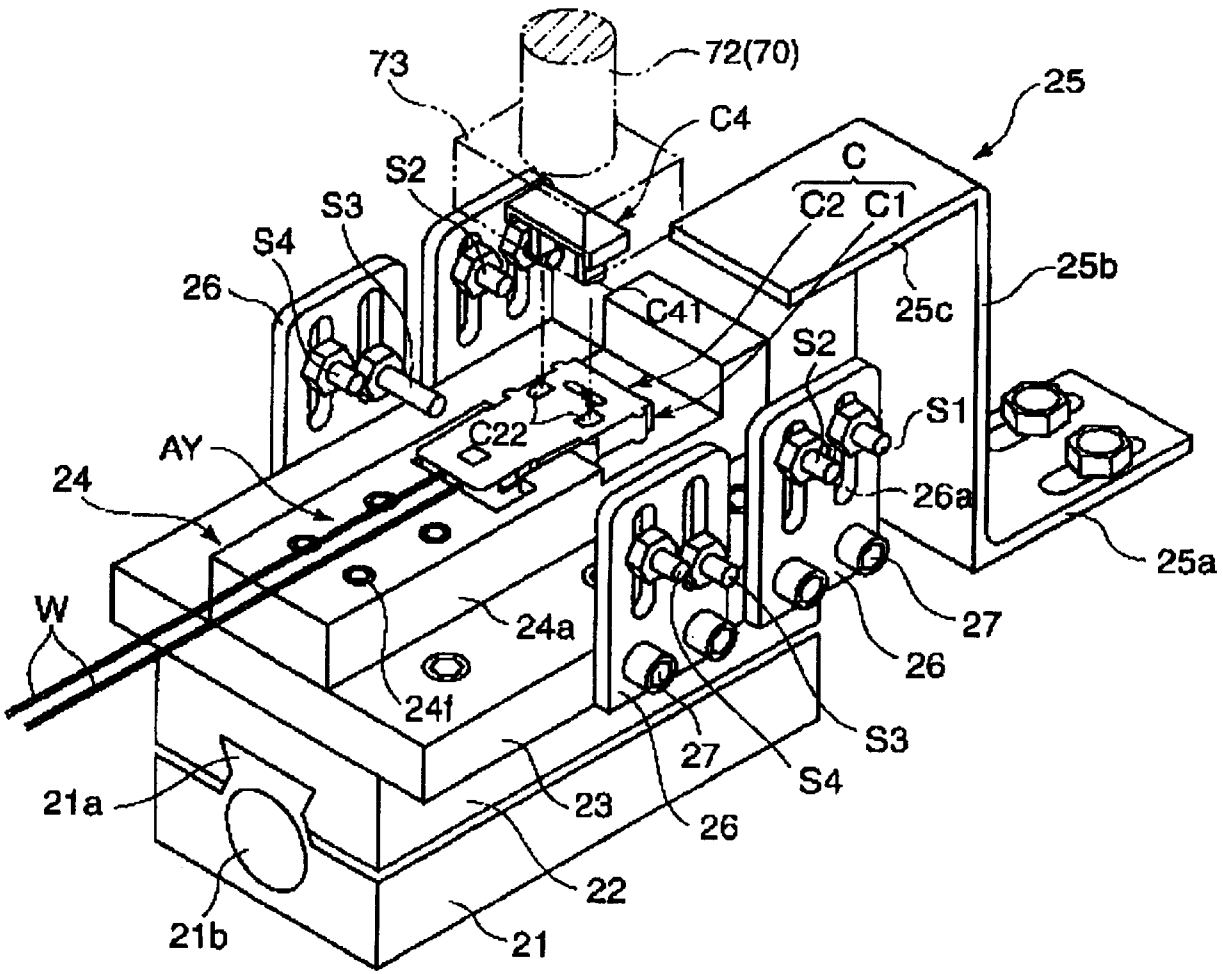

As a result, as shown in FIG. 14, the vacuum holder 73 faces the palette assembly 20 above the vacuum holder 73, and the lock C4 sucked by the vacuum holder 73 can be positioned to be mounted into the connector housing C on the holder 24 by returning the palette assembly 20 to the housing mounting position. Thereafter, the rod 72 of the air cylinder 70 is extended again to lower the vacuum holder 72, and the lock C4 held by the vacuum holder 73 is mounted into the connector housing C to complete assembling.

Upon completion of the assembling operation, the control unit 100 activates the notification buzzer to signal completion of the assembling operation and returns the respective devices to their initial positions.

As described above, the steps of fully mounting the wire assembly AY, turning the housing cover C2, connecting the housing cover C2 with the housing main body C1, and fully mounting the lock C4 into the connector housing C can be automated in this embodiment.

The cover C2 of the connector housing C contacts the push-up projection 24*c* and is pushed up to a specified position during the mounting of the connector housing C on the holder 24. Thus, the cover turning mechanism and the turning operation by the cover turning mechanism (palette unit 20 and housing cover closing stay 25) can be simplified.

The pushing holder 53 of the assembly pushing mechanism has the probe pins 56 that function as detecting elements, and the electrical connection test for the wire assembly AY is conducted while the wire assembly AY is being pushed by the probe pins 56. Accordingly, the electrical connection test can be conducted when the wire assembly AY is mounted fully in the connector housing C. Consequently, the automatic assembling and the electrical connection test can be performed simultaneously, thereby enabling efficient automatic production of connectors of a higher quality.

The lock inserting mechanism is provided with the lock feed unit 30 for feeding the lock C4 to a predetermined lock feed position, the pick-up unit (air cylinder 70, vacuum holder 73, etc.) for picking up the lock C4 fed to the lock feed unit 30 from the lock feed position, and the pick-up unit drive (rod-less cylinder 42, etc.) for driving the pick-up unit between the lock feed position and the mounting position of the lock into the connector housing. Further, the control unit 100 links the operations of the pick-up unit, the pick-up unit drive and the cover mounting mechanism (air cylinder 60, etc.) to synchronize the lock pick-up operation and the operation of fully connecting the cover C2 with the main body C1 by the cover connecting mechanism (air cylinder 60, etc.). Additionally, the lock feed position is set to enable the pick-up operation and fully connecting operation to be performed simultaneously. Thus, the respective operations can be performed in parallel as efficiently as possible.

As described above, a series of operations from the cover closing operation to the lock mounting operation can be performed automatically merely by actuating the operation switch 101 after the connector housing C is mounted on the palette 24 and the wire assembly AY is placed temporarily. Thus, remarkable effects of a considerably reduced burden on the operator and an improved production efficiency can be obtained.

The foregoing embodiment is merely an illustration of a preferred specific example of the present invention and the present invention is not limited thereto. It should be appreciated that various design changes can be made without departing the scope of the present invention as claimed.

Even though some operations are described as being performed by an operator, at least certain actions or operations performed by the operator also may be automated.

As described above, a series of operations from the cover closing operation to the lock mounting operation can be performed automatically. Therefore, a considerably reduced burden on the operator and an improved production efficiency can be obtained.

What is claimed is:

1. An automatic connector assembling apparatus (10) for mounting a wire assembly (AY) in a connector housing (C), the connector housing (C) comprising a main body (C1) for accommodating a portion of the wire assembly (AY), a cover (C2) connected to the main body (C1), and a lock (C4) inserted into the connector housing (C) having the wire assembly (AY) mounted therein, comprising:

at least one palette assembly (20; 24) for holding the main body (C1), an assembly pushing mechanism (50; 53, 53*a*; 54) for pushing the portion of the wire assembly (AY) from a temporary mount position on the main body (C1) to a fully mounted position in the main body (C1) while the main body (C1) is on the palette assembly (20; 24), a cover turning mechanism (20; 25) for turning the cover (C2) toward the main body (C1) after the portion of the wire assembly (AY) is fully mounted by the assembly pushing mechanism (50; 53, 53*a*; 54), a lock inserting mechanism (70; 73) for inserting the lock (C4) into the connector housing (C) after the cover (C2) is connected, and a control means (100) for controllably driving the respective mechanism to perform operations of fully mounting the portion of the wire assembly (AY) into the housing main body (C1), turning the housing cover (C2) after the portion of the wire assembly (AY) is substantially fully mounted, connecting the turned cover (C2) with the main body (C1), and inserting the lock (C4) into the connector housing (C) assembled by connecting the cover (C2) with the main body (C1).

2. An automatic connector assembling apparatus according to claim 1, further comprising a cover pushing mechanism (60; 63) for pushing the turned cover (C2) against the main body (C1) to connect the cover (C2) and the main body (C1), wherein the lock inserting mechanism (70; 73) inserts the lock (C4) into the connector housing (C) after the cover (C2) is connected by the cover pushing mechanism.

3. An automatic connector assembling apparatus according to claim 1, wherein the palette assembly (20; 24) comprises at least one push-up projection (24*c*) for contacting the cover (C2) while the main body (C1) is being mounted and pushing up the cover (C2) into a state where the wire assembly (AY) is mountable.

4. An automatic connector assembly apparatus according to claim 3, wherein the push-up projection (24*c*) is formed to position the cover (C2) at a position where the cover (C2) does not hinder mounting the wire assembly (AY) into the connector housing (C).

5. An automatic connector assembling apparatus according to claim 1, wherein the cover turning mechanism (20; 25) comprises a stay (25) for contacting the cover (C2) and turning the cover (C2) toward the main body (C1) when at least one portion (22) of the palette assembly (20; 24) is moved towards the stay (25).

6. An automatic connector assembling apparatus according to claim 1, wherein sensors (S1; S2; S3; S4) are provided to determine: whether an engagement of the main body (C1) of the connector housing (C) and a hinge (C14; C24) of the cover (C2) is satisfactory (S1); whether the lock (C4) is mounted (S2); whether (S3) a component of the wire assembly (AY) is present in the connector housing (C); and whether a connection of the main body (C1) and the cover (C2) is satisfactory (S4).

7. An automatic connector assembling apparatus according to claim 1, wherein the assembly pushing mechanism (50; 53, 53*a*; 54) comprises detecting elements (54) for conducting an electrical connection test for the wire assembly (AY) while the wire assembly (AY) is being pushed.

8. An automatic connector assembling apparatus according to claim 1, wherein the lock inserting mechanism (70; 73) comprises:

a lock feeding unit (30) for feeding the lock (C4) to a lock feed position, a pick-up unit (70; 73) for picking up the lock (C4) fed to the lock feed unit (30) from the lock feed position, and a pick-up unit drive (42) for driving the pick-up unit (70; 73) between the lock feed position and a position of mounting the lock (C4) into the connector housing (C), wherein the control means (100) controllably links the operations of the pick-up unit (70; 73), the pick-up unit drive (42) and the cover pushing mechanism (60; 63) to synchronize a lock pick-up operation and a cover mounting operation by the cover pushing mechanism (60; 63).

9. An automatic connector assembly apparatus according to claim 8, wherein the lock feed position is set to enable the pick-up operation and the cover mounting operation to be performed simultaneously.

10. An automatic connector assembling method for mounting a wire assembly (AY) in a connector housing (C), the connector housing (C) comprising a main body (C1) for accommodating a portion of the wire assembly (AY), a cover (C2) connected to the main body (C1), and a lock (C4) insertable into the connector housing (C) having the wire assembly (AY) mounted therein, comprising the steps of:

holding the housing main body (C1) on a palette assembly (20; 24);

fully mounting the portion of the wire assembly (AY) into the main body (C1) on the palette assembly (20; 24);

turning the housing cover (C2) toward the main body (C1) after the portion of the wire assembly (AY) is substantially fully mounted, inserting the lock (C4) into the connector housing (C) after the cover (C2) is connected, and wherein the steps are controlled to perform operation of: fully mounting the portion of the wire assembly (AY) into the housing main body (C1); turning the cover (C2) after the portion of the wire assembly (AY) is substantially fully mounted; connecting the turned cover (C2) with the main body (C1); and inserting the lock (C4) into the connector housing (C) assembled by connecting the cover (C2) with the main body (C1).

11. An automatic connector assembling apparatus (10) for mounting a wire assembly (AY) in a connector housing (C), the connector housing (C) comprising a main body (C1) for accommodating a portion of the wire assembly (AY), a cover (C2) connected to the main body (C1), and a lock (C4) inserted through the cover (C2) and into the connector housing (C) for locking the cover (C2) to the main body (C1), comprising:

a holder (24) for holding the main body (C1);

a projection (24*c*) formed on the holder (24) for aligning the cover (C2) at an obtuse angle relative to the main body (C1) when the main body (C1) is mounted in the holder (24);

an assembly pushing mechanism (50; 53, 53*a*; 54) for mounting the portion of the wire assembly (AY) into the main body (C1);

a cover turning mechanism (20; 25) for turning the cover (C2) toward the main body (C1) after the portion of the wire assembly (AY) is mounted; and a lock inserting mechanism (70; 73) for inserting the lock (C4) into the connector housing (C) after the cover (C2) is turned.

12. An automatic connector assembling apparatus according to claim 11, further comprising a cover pushing mechanism (60; 63) for pushing the turned cover (C2) against the main body (C1), wherein the lock inserting mechanism (70; 73) inserts the lock (C4) into the connector housing (C) after the cover (C2) is connected by the cover pushing mechanism.

13. An automatic connector assembling apparatus according to claim 12, wherein the cover turning mechanism (20; 25) comprises a stay (25) for contacting the cover (C2) and turning the cover (C2) toward the main body (C1) when at least one portion (22) of the palette assembly (20; 24) is moved towards the stay (25).

14. An automatic connector assembling apparatus according to claim 12, wherein the assembly pushing mechanism (50; 53, 53*a*; 54) comprises detecting elements (54) for conducting an electrical connection test for the wire assembly (AY) while the wire assembly (AY) is being pushed.

* * * * *